US006711268B2

(12) United States Patent
Colegrave et al.

(10) Patent No.: US 6,711,268 B2
(45) Date of Patent: Mar. 23, 2004

(54) AUTOMATIC STEREO/MONAURAL HEADPHONE

(75) Inventors: Arthur Barry Colegrave, Costa Mesa, CA (US); Richard Goldstein, Northbrook, IL (US)

(73) Assignee: Enztec Audio Ltd., Auckland (NZ)

( * ) Notice: Subject to any disclaimer, the term of this patent is extended or adjusted under 35 U.S.C. 154(b) by 477 days.

(21) Appl. No.: 09/849,820

(22) Filed: May 4, 2001

(65) Prior Publication Data

US 2002/0012435 A1 Jan. 31, 2002

Related U.S. Application Data

(60) Provisional application No. 60/212,807, filed on Jun. 19, 2000.

(51) Int. Cl.[7] ..... H04R 1/10

(52) U.S. Cl. ..... 381/74; 381/11; 381/1; 381/26

(58) Field of Search ..... 381/74, 11, 26, 381/384, 1

(56) References Cited

U.S. PATENT DOCUMENTS

| | | | | | |
|---|---|---|---|---|---|
| 4,219,789 | A | * | 8/1980 | Frangos | 333/32 |
| 4,433,209 | A | * | 2/1984 | Kurosawa et al. | 381/1 |
| 4,829,571 | A | * | 5/1989 | Kakiuchi et al. | 381/309 |
| 5,642,424 | A | * | 6/1997 | Masaki | 381/309 |
| 5,655,025 | A | * | 8/1997 | Kim et al. | 381/11 |
| 6,069,960 | A | * | 5/2000 | Mizukami et al. | 381/74 |
| 6,594,366 | B1 | * | 7/2003 | Adams | 381/74 |

* cited by examiner

*Primary Examiner*—Minsun Oh Harvey
*Assistant Examiner*—Laura A. Grier

(57) ABSTRACT

A stereo headphone employing a standard stereo headphone plug is adapted for automatically hearing a monaural signal at both earpieces, when accessing a typical monaural source. In the first embodiment of the invention, an impedance element couples the signal from a first acoustical driver that receives the monaural signal from the stereo plug tip, to a second acoustical driver that is connected to the stereo plug ring and normally receives no signal when plugged into a conventional monaural audio source output jack. The magnitude of the coupling impedance is selected with respect to the impedance of the acoustical driver so that the reduction in loudness at the second earpiece due to the signal voltage drop across the coupling impedance is not perceptible to the listener. This will occur when the reduction in loudness at the second earpiece is less than the threshold of perceivable loudness reduction at one ear when there is no reduction in loudness at the other ear. The effect of the coupling impedance, when listening to a stereo audio source is insignificant, firstly, because the two stereo channel signals appear at their respective drivers with virtually no attenuation due to the coupling impedance. Secondly, although the coupling impedance does contribute a slight amount of additional crosstalk between the stereo channels, the magnitude of the increase in crosstalk is dependent upon the ratio of the coupling impedance to the output impedance of the stereo source. A typical stereo source for which the use of this headphone is intended has an output impedance so low compared to the coupling impedance that the increase in crosstalk is too small to be perceptible as affecting the stereo separation or the stereo imaging afforded by the stereo source. In the second embodiment of the invention two equal impedance elements couple the monaural signal from the stereo plug tip to each acoustical driver. This equalizes the loudness of the monaural signal heard at each earpiece and slightly reduces the level of one stereo channel with respect to the other. Crosstalk and stereo imaging are virtually unaffected, as with the first embodiment.

10 Claims, 9 Drawing Sheets

AUTOMATIC STEREO/MONAURAL HEADPHONE

RELATED APPLICATION

This application claims the benefit of Provisional Application No. 60/212,807 filed Jun. 19, 2000 entitled AUTOMATIC STEREO/MONAURAL HEADPHONE.

BACKGROUND OF THE INVENTION

This invention relates to headphones designed primarily for classroom use in the education environment. A great variety of audio and audio-visual equipment is now commonly employed for instructional purposes in school classrooms. The use of headphones for students to listen to instructional audio material is often desirable in order to provide a noise-free private environment for individual and small group instruction. These audio sources include study carrels, phonographs, tape players, compact disk players, video displays, film projectors, and computers. The audio sources commonly employed in the education environment may be monaural or stereo and are often accessed by a single jack that accepts only a ⅛-inch or a ¼-inch headphone plug. This has resulted in difficulty for teachers and equipment custodians to stock and maintain control of headphone equipment for use with all of these various audio sources.

PRIOR ART

Existing headphone designs for accessing the various audio sources described above are shown in FIG. 1 and FIG. 2. FIG. 1A discloses a headphone 10 that includes left and right earpieces 12 and 14 respectively, a connection cord 18 terminated in a stereo plug 16 and an "in-line" switch 20 to select a stereo or monaural source. FIG. 1B is a circuit diagram showing the switch 20 set for a stereo source. It shows a common connection from the plug sleeve-contact 22 to like identified terminals (+) of the two earpiece drivers 13 and 15. The plug ring-contact 24 is connected to the other identified terminal (−) of the left earpiece driver 13 and the plug tip-contact 26 is connected to the corresponding identified terminal (−) of the right earpiece driver 15. This setting provides normal stereo listening from a stereo source. FIG. 1C shows the circuit diagram with the switch 20 set to access a monaural source. There is no connection to the plug 16 ring-contact 24. The plug 16 tip-contact 26 is connected to the (−) terminals of the earpiece drivers 13 and 15. This allows a monaural source to be heard in both ears. A plug adapter 28 provides access to audio sources that accept only a ¼-inch plug.

Although a headset with a mono/stereo selection switch would require only the addition of a single stereo plug adapter to change the headset plug size, the use of such a switch for selecting a monaural or stereo source has not found favor in the education environment for the following reasons:

1. The selection switches are likely to be played with by the students and have not proved to have the ruggedness and reliability required for classroom use, and;
2. The source must be positively identified prior to making a switch selection.
3. Teachers prefer to configure the headset for the proper source when used by younger children so they cannot easily change it to the wrong configuration.

FIG. 2 discloses additional prior art for a headphone system that can access either a monaural or stereo audio source that accepts only a ¼-inch or ⅛-inch plug. FIG. 2A shows a stereo headset 30 consisting of an adjustable headband 32, left and right earpieces 34 and 36 respectively, connection cord 38 terminated in a molded plug assembly 40 that includes a ⅛-inch stereo plug 42. The plug 42 includes external screw threads 58 that mate with internal screw threads of three plug adapters 44, 46 and 48. A plastic holder 50 for the plug adapters is secured to the connection cord 38 to store them when not in use. These plug adapters are shown enlarged in outline drawings in FIG. 2C. FIG. 2B is a schematic diagram of the headset for accessing a stereo source with the ⅛-inch stereo plug 42. The ring-contact 54 is connected to the (−) terminal of the left earpiece driver 35 and the tip-contact 56 is connected to the (−) terminal of the right earpiece driver 37. A connection to the (+) terminal of each earpiece driver is made to the sleeve-contact 52 of the plug 42.

Plug adapter 44 shown in FIG. 2C converts the headset 30 for listening to a monaural source equipped with a ¼-inch output jack. It connects the tip-contact 60 to both the tip-contact 56 and to the ring-contact 54 of the stereo plug 42 shown in FIG. 2B thus allowing the audio source to be heard at both earpieces 34 and 36 of the headset. Sleeve-contact 62 connects the source sleeve circuit to sleeve-contact 52 of plug 42. Similarly plug adapter 46 provides for listening to a monaural source equipped with a ⅛-inch output jack. It connects the tip-contact 64 to both the tip-contact 56 and to the ring-contact 54 of the stereo plug 42 shown in FIG. 2B thus allowing a monaural audio source equipped with a ⅛-inch output jack to be heard at both earpieces 34 and 36 of the headset.

Plug adapter 48 shown in FIG. 2C adapts the ⅛-inch stereo plug 42 of the headset to a stereo source equipped with a ¼-inch stereo jack. It connects the tip-contact 68, the ring-contact 70, and the sleeve-contact 72 to their respective contacts 56, 54 and 52 of plug 42 thus providing for normal stereo listening to the source.

SUMMARY OF THE INVENTION

The headphone design of this invention accesses a monaural or stereo source with a connection cord preferably terminated in a ⅛-inch stereo plug. In a first embodiment of the invention the right and left signals from a stereo source are connected in a normal manner directly to each earpiece driver; that is, the right channel is connected to an identified terminal of one (usually the right) earpiece driver, and the left channel is connected to a similarly identified terminal of the other earpiece driver. A common connection from the stereo source is connected to the other terminal of each earpiece driver. In this embodiment of the invention a connection is also made between the right and left channel identified terminals of the earpiece drivers through an impedance element. The magnitude of the impedance element is chosen with respect to the impedance of the earpiece drivers such that an audio signal appearing at only one earpiece driver terminal, as would be the case with a monaural source, is coupled to the other earpiece driver with a reduction in signal strength at the other earpiece driver terminal of the order of two decibels. This slight reduction in loudness in one ear is virtually imperceptible to the listener, probably aided by a psycho-acoustical effect that masks the slight reduction in loudness in one ear if the other ear suffers no reduction in loudness.

The impedance element results in a slight mixing of right and left channel audio signals from a stereo source. The amount of channel mixing described above is so small that stereo separation is virtually unaffected and no reduction of stereo imaging is perceptible to the listener. The reason for this small amount of channel mixing is the typical low impedance of the audio sources compared to the value of the impedance element; a ratio of about one hundred. This results in the crosstalk between channels caused by the impedance to be about 40 decibels below the level of either channel, a level well below the channel separation requirement for good stereo performance.

In a second embodiment of the invention the stereo channel that is connected to the ring contact of the stereo plug is connected directly to one earpiece driver and the other channel that is connected to the tip of the stereo plug is connected to each earpiece driver through a an impedance element. A monaural source is always accessed by the plug tip, and thus each earpiece driver is connected to the source through one of the impedance elements. If each impedance element is one-half the value of the impedance element used in the first embodiment described above the monaural signal will be heard at each earpiece with equal loudness at a level of the order of one decibel less than if a direct connection to each earpiece driver had been made as in a conventional stereo headset. With a stereo source one channel will be heard with no reduction in loudness compared to a conventional stereo headset and the other channel will be heard with reduced loudness of the order of one decibel. This slight difference in the level of the stereo channels is not perceptible and can be easily balanced, if desired, by a balance control available with many stereo sources. Again, because of the typical low impedance of the stereo source, the stereo crosstalk due to the coupling impedance elements is about −34 decibels, providing excellent stereo performance.

Thus the headset can be used with either a monaural or stereo source without requiring any action to identify the nature of the source or configure the headset for the type of audio source, while providing virtually the same efficacy of use as a separate headphones dedicated to either a monaural or stereo source, or a headphone provided with a mono/stereo switch selector, or a headphone employing stereo-to-monaural plug adapters.

Accordingly, it is an object of the invention to provide a headphone that can be used for automatic listening to a monaural or stereo audio source, that does not have to be configured for the type of audio source, and that provides for hearing with substantially equal loudness at both earpieces either a monaural signal or equal magnitude right and left channel stereo signals and with which the stereo source is heard with right and left channel separation and stereo imaging substantially as afforded by the stereo source.

It is a further object of this invention to provide at a lower cost than heretofore possible a headphone that requires no switching means and only one plug adapter to access the four configurations of sources represented by a monaural or stereo source with either a single ⅛-inch or single ¼-inch output jack.

DESCRIPTION OF THE INVENTION

The invention is described with reference to FIGS. 3–9.

Figure 1B:
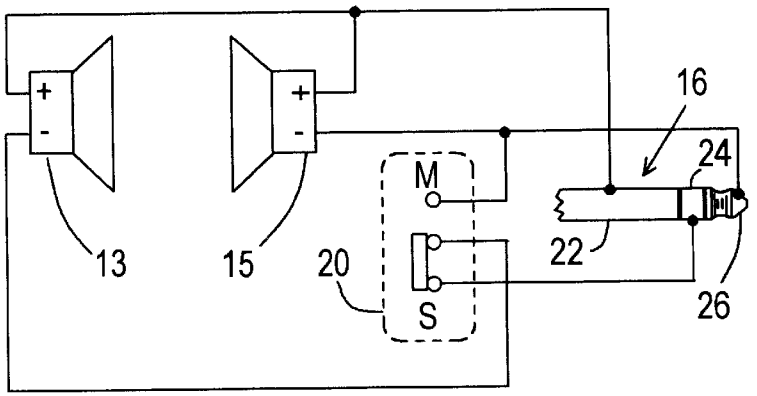
FIG. 1 is a drawing of prior art showing a headphone that employs a Monaural-Auto selection switch to select a monaural or stereo audio source.
Figure 1C:
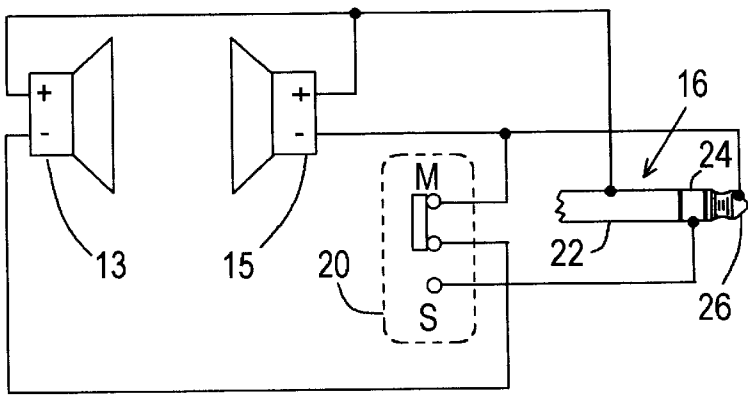
Figure 1A:
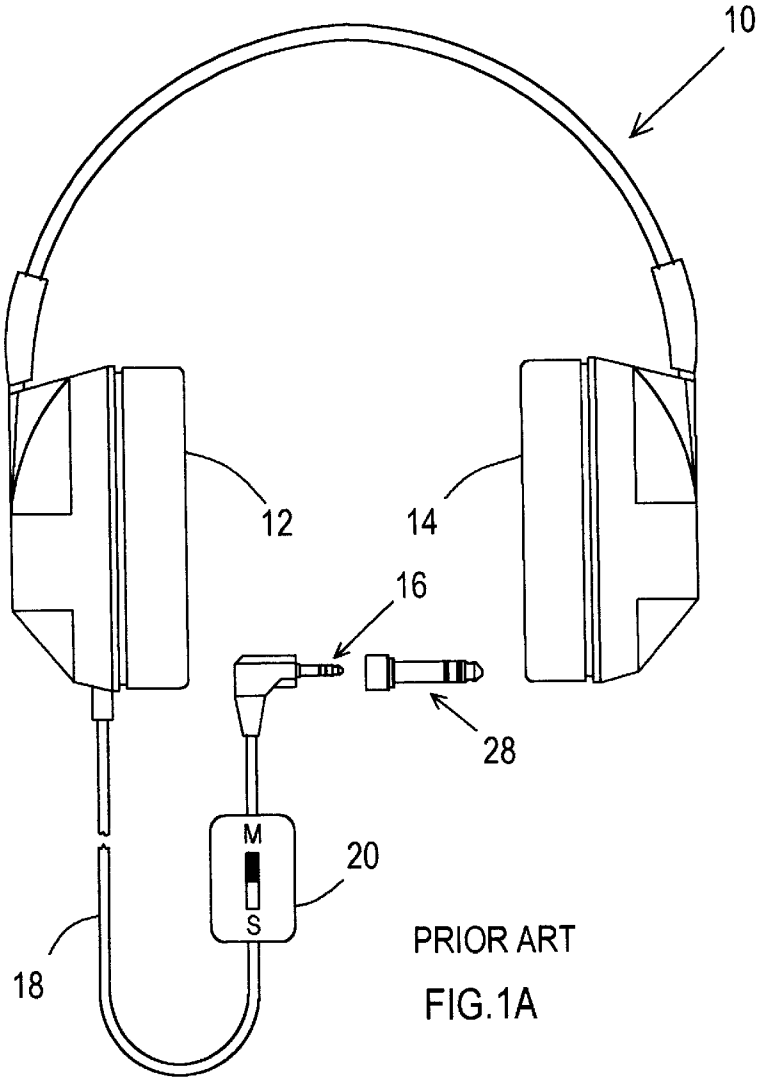
PRIOR ART FIG.1A
Figure 2B:
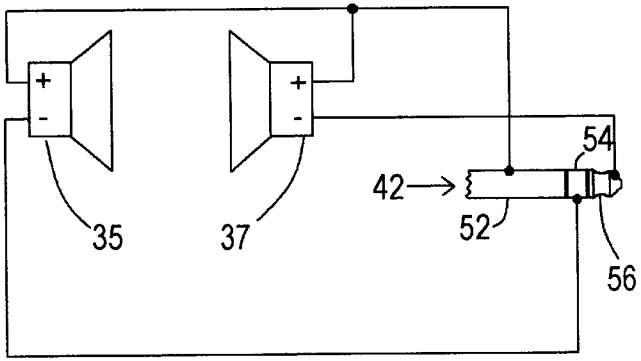
FIG. 2 is a drawing of prior art showing a headphone that employs plug adapters to select a monaural or stereo audio source.
Figure 2C:
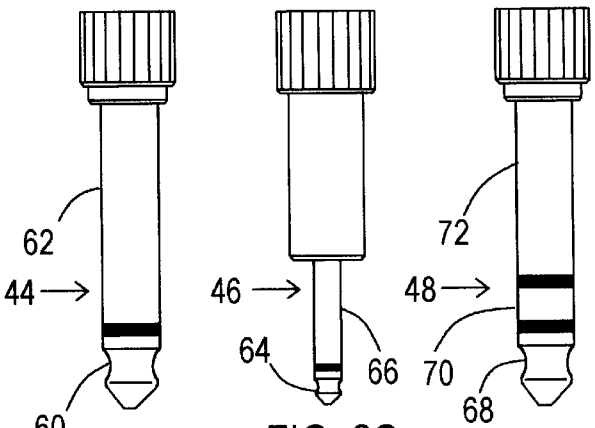
Figure 2A:
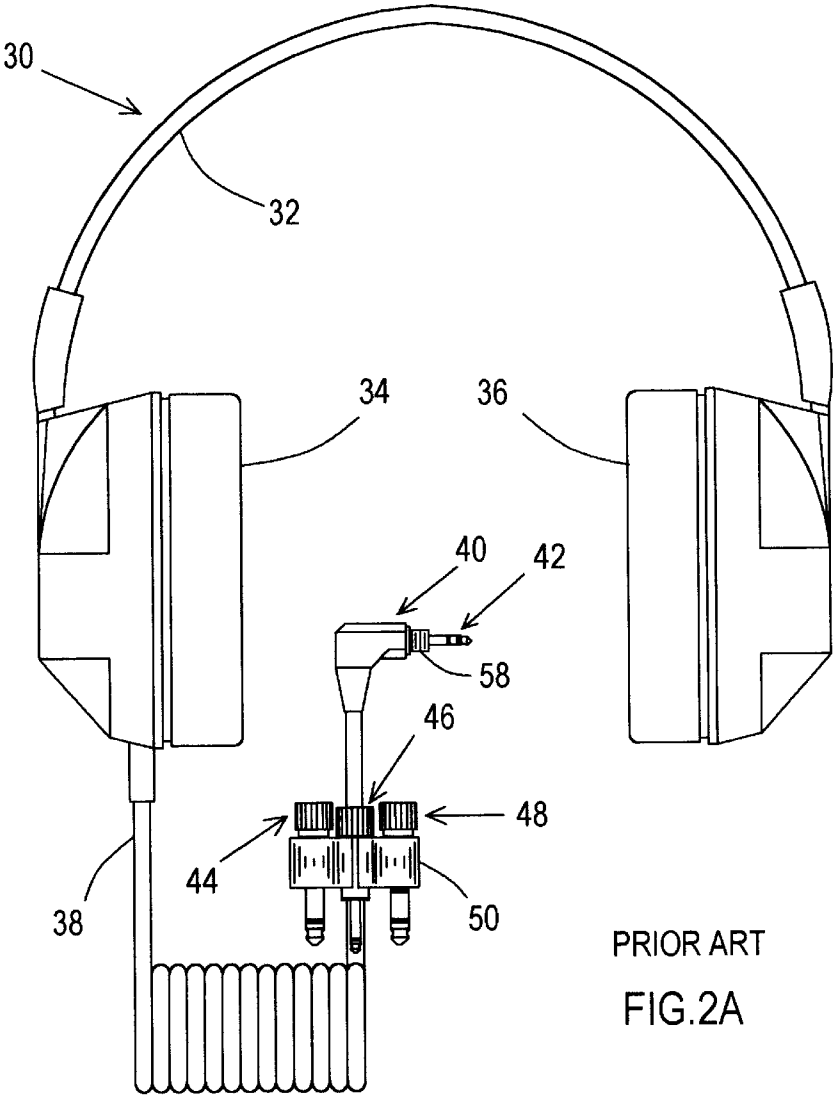
PRIOR ART FIG.2A
Figure 3:
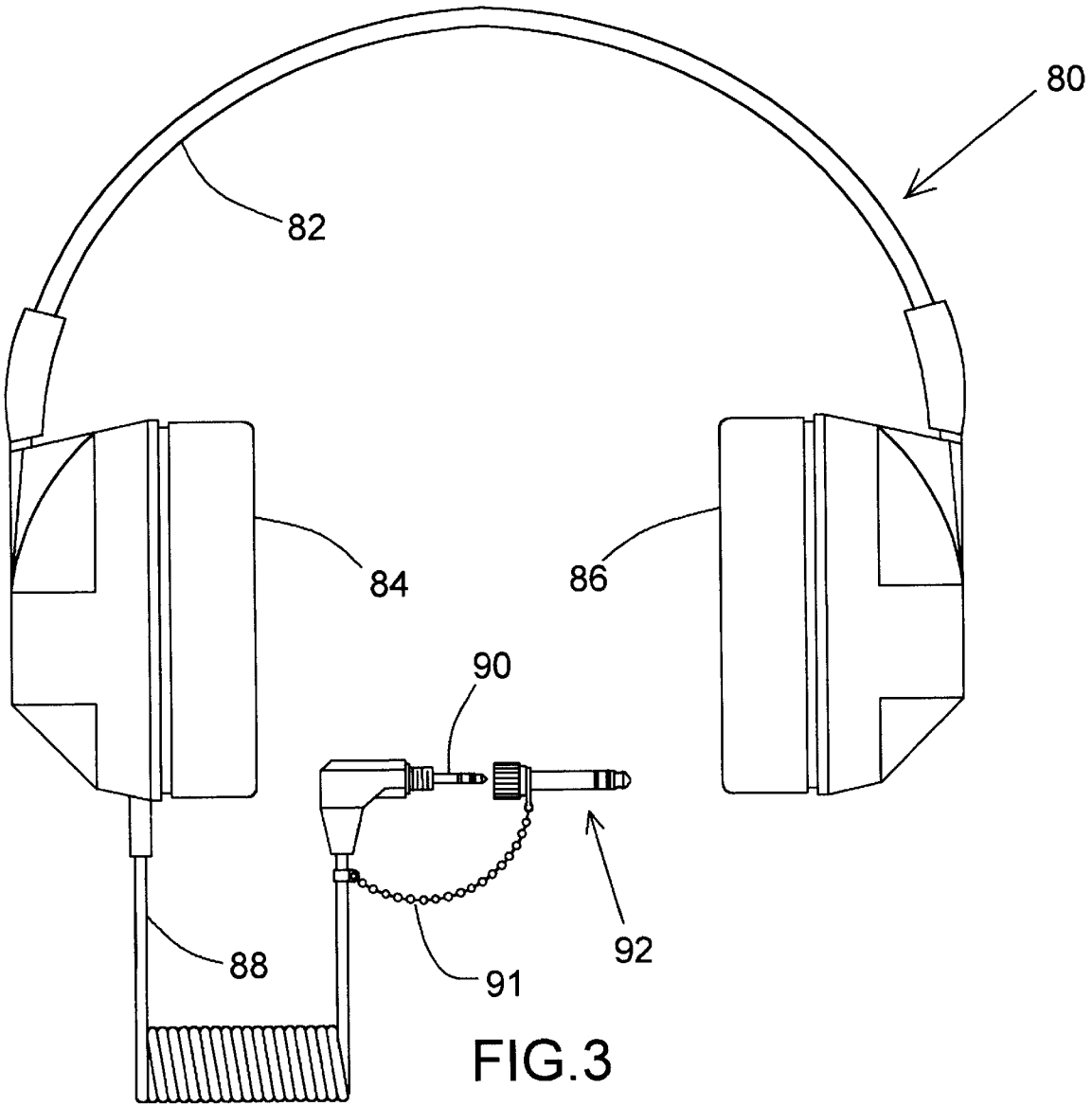
FIG. 3 is a drawing of the present invention.
Figure 4:
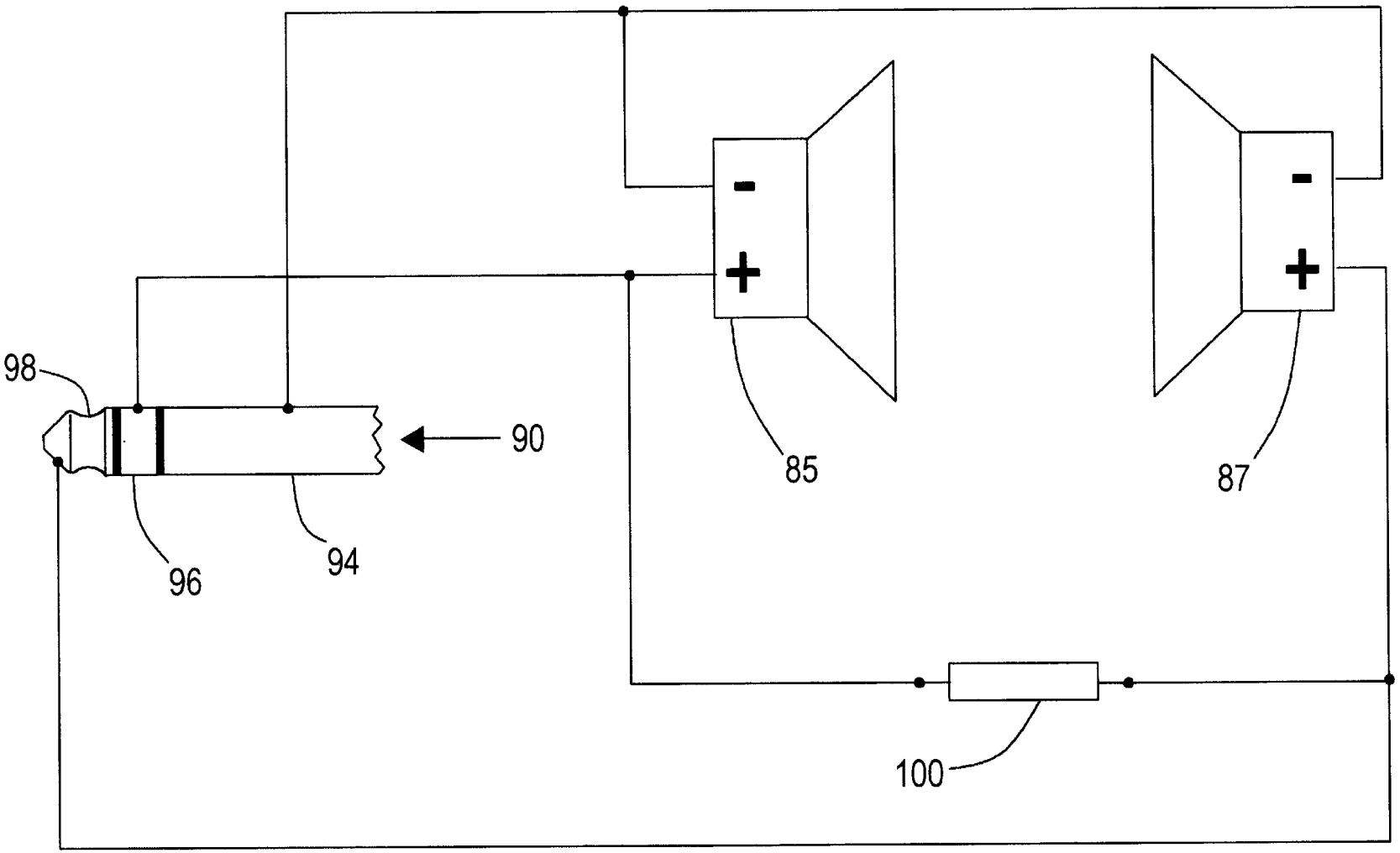
FIG. 4 is a schematic drawing of a first embodiment the present invention.

FIG. 3 shows what appears to be a conventional stereo headset 80 that includes an adjustable headband 82, left earpiece 84, right earpiece 86, a connection cord 88 that is terminated in a ⅛-inch stereo plug 90. A screw-on ⅛-inch to ¼-inch stereo plug adapter 92 is provided with the headset. The adapter 92 is attached to the headphone cord 88 by bead-chain 91 to prevent it from becoming misplaced and lost. FIG. 4 illustrates the internal construction of a first embodiment of the invention. The tip 98 of the stereo plug 90 is connected to the + terminal of the right earpiece driver 87 and the ring contact 96 of the stereo plug 90 is connected to the + terminal of the left earpiece driver 85. The sleeve 94 of the stereo plug 90 is connected to the negative terminal of each earpiece driver. These are the normal connections of a conventional stereo headset. In this embodiment of the invention an impedance element consisting of a single resistor 100 is connected between the + terminals of the earpiece drivers, that is, from the plug tip 98 to the plug ring contact 96 of the stereo plug 20. Therefore, the resistor can be located in the plug assembly 90. In the construction shown in FIG. 3 the connection cord enters the left earpiece 84 and connection to the right earpiece 86 is made by conductors passing through the headband 82, thus allowing the resistor to be alternatively located in the left earpiece instead of in the plug assembly.

Figure 5:
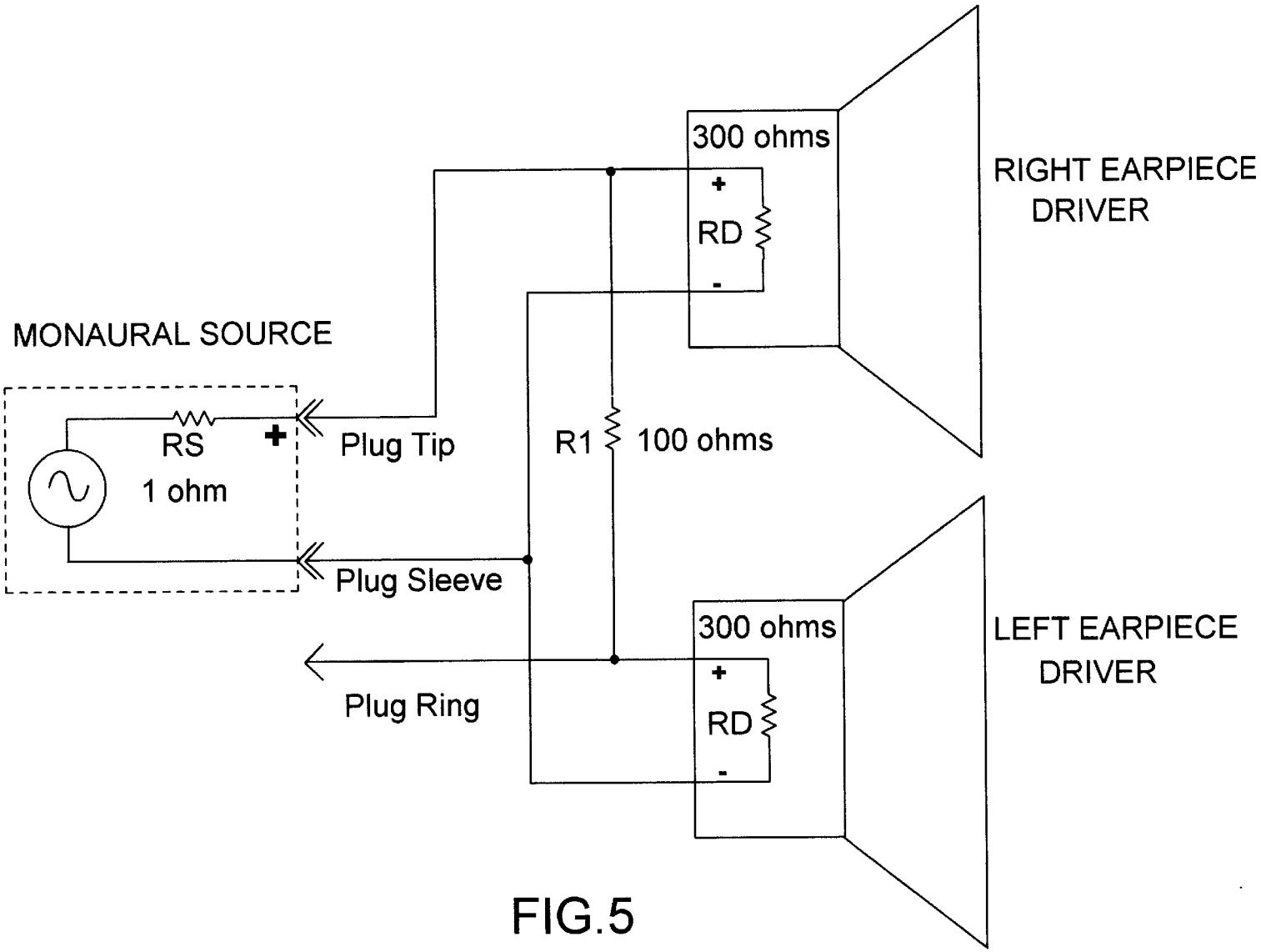
FIG. 5 is a schematic drawing of a first embodiment the present invention showing its connection to a monaural audio source.

The value of the resistor 100 is selected with respect to the impedance of the earpiece driver 87 shown in FIG. 4 such that the reduction in loudness at the left earpiece is acceptable to the listener. FIG. 5 is a schematic diagram of a typical headphone employed in this invention when connected to a monaural audio source. For the earpiece driver $R_D$ impedance of 300 ohms, the resistor $R_1$ is given a value of 100 ohms. This reduces the MONAURAL SOURCE signal level at the left earpiece to 75%, or about 2.5 decibels. On the basis of A/B tests with the resistor $R_1$ switched in or out, there was no perceptible difference in loudness among the listeners tested, and all listeners felt that they were hearing the monaural signal satisfactorily in both ears. Many listeners could detect a loudness reduction of one decibel when loudness is reduced in both ears or when listening with only one ear. Since the loudness ratio of one decibel was originally established as that representing the threshold of loudness difference perceptible to the human ear this is not a surprising result. It is believed that the imperceptibility of loudness reduction of 2 to 3 decibels at just one ear in the tests mentioned above results from a psycho-acoustic effect in which the brain masks this degree of loudness reduction if occurring at only one ear.

Figure 6:
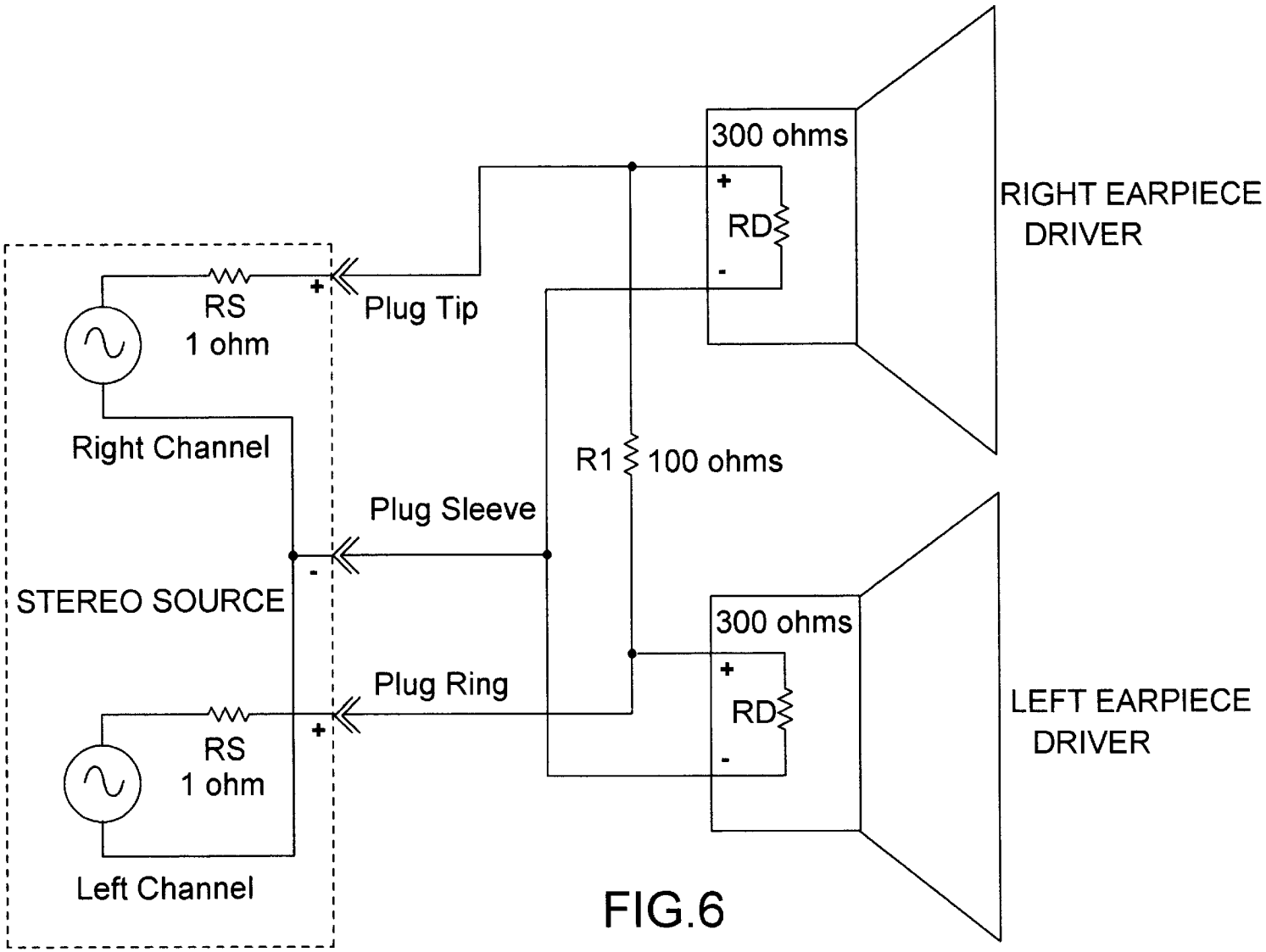
FIG. 6 is a schematic drawing of a first embodiment the present invention showing its connection to a stereo audio source.

FIG. 6 is a schematic diagram of the embodiment of the invention shown in FIG. 3 when plugged into a stereo source. It can be seen that the right and left channel stereo sources are connected directly to their respective earpiece drivers. The typical output impedance of the various audio sources cited above is of the order of one ohm, and that value is used in these illustrations. It can be shown that the stereo signals will be delivered to the earpiece drivers with negligible reduction (about 0.1 decibels) in loudness due to the 100-ohm resistor $R_1$, compared to dedicated headphones.

The 100-ohm resistor $R_1$ will also couple some signal from each stereo channel into the other channel resulting in a small amount of crosstalk between channels. Such crosstalk tends to reduce the channel separation upon which stereo imaging is dependent. Stereo imaging depends upon both phase and delay differences as well as magnitude differences between channels and satisfactory imaging can be achieved with channel amplitude separation as little as 10 decibels. Because of the large ratio (100:1) of $R_1$ to the source resistance $R_S$, crosstalk contributed by the resistor $R_1$ is −40 decibels, and is virtually imperceptible.

Figure 7:
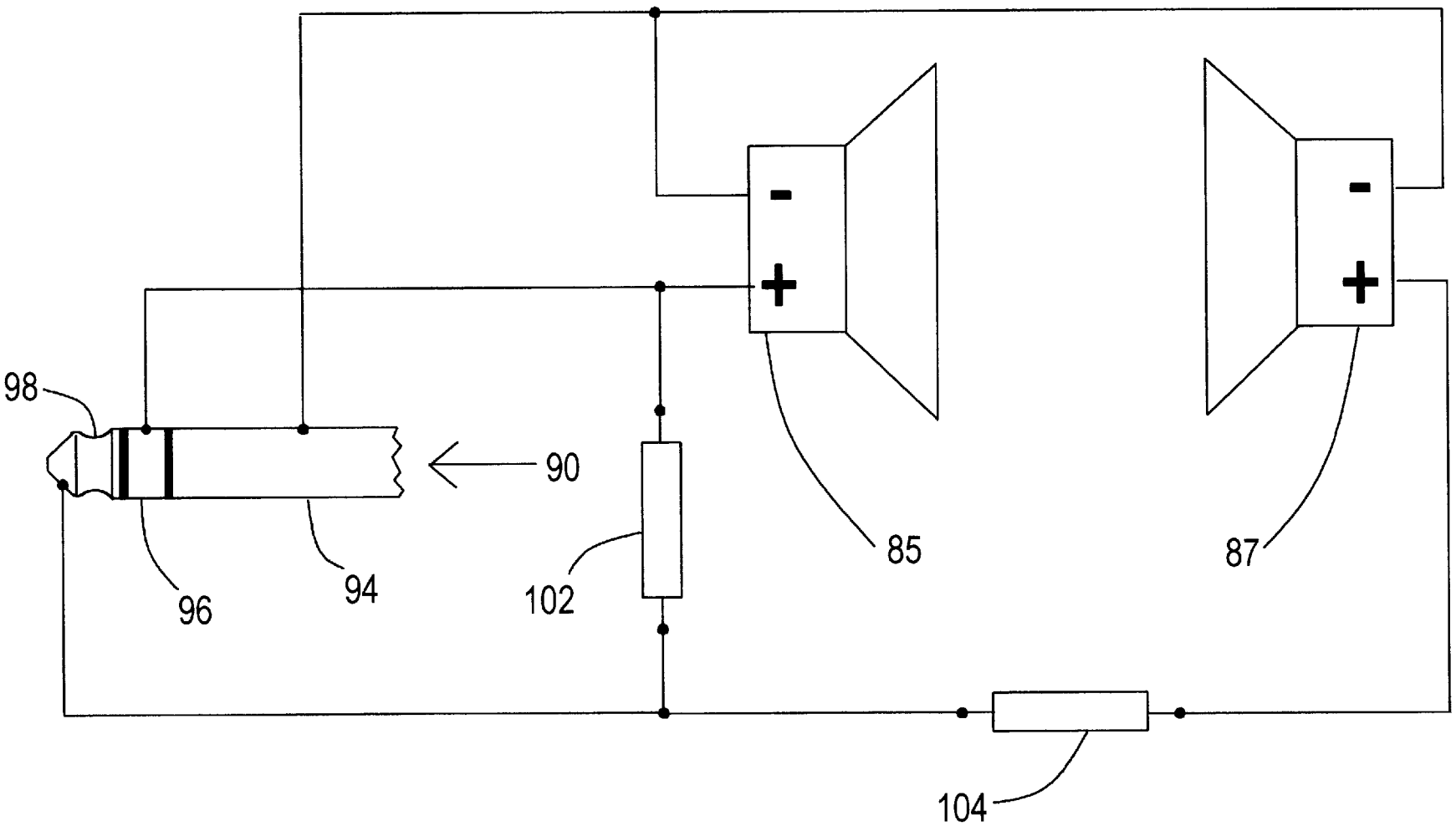
FIG. 7 is a schematic drawing of a second embodiment the present invention.

FIG. 7 shows a second embodiment of the invention. In order to equalize the loudness at both ears when accessing a monaural source, the plug tip 98 of the stereo plug 90 is connected to each of the earpiece drivers 85 and 87 through resistors 102 and 104 that are of equal value. The left earpiece driver 85 is directly connected to the ring contact 96 of the stereo plug 90.

Figure 8:
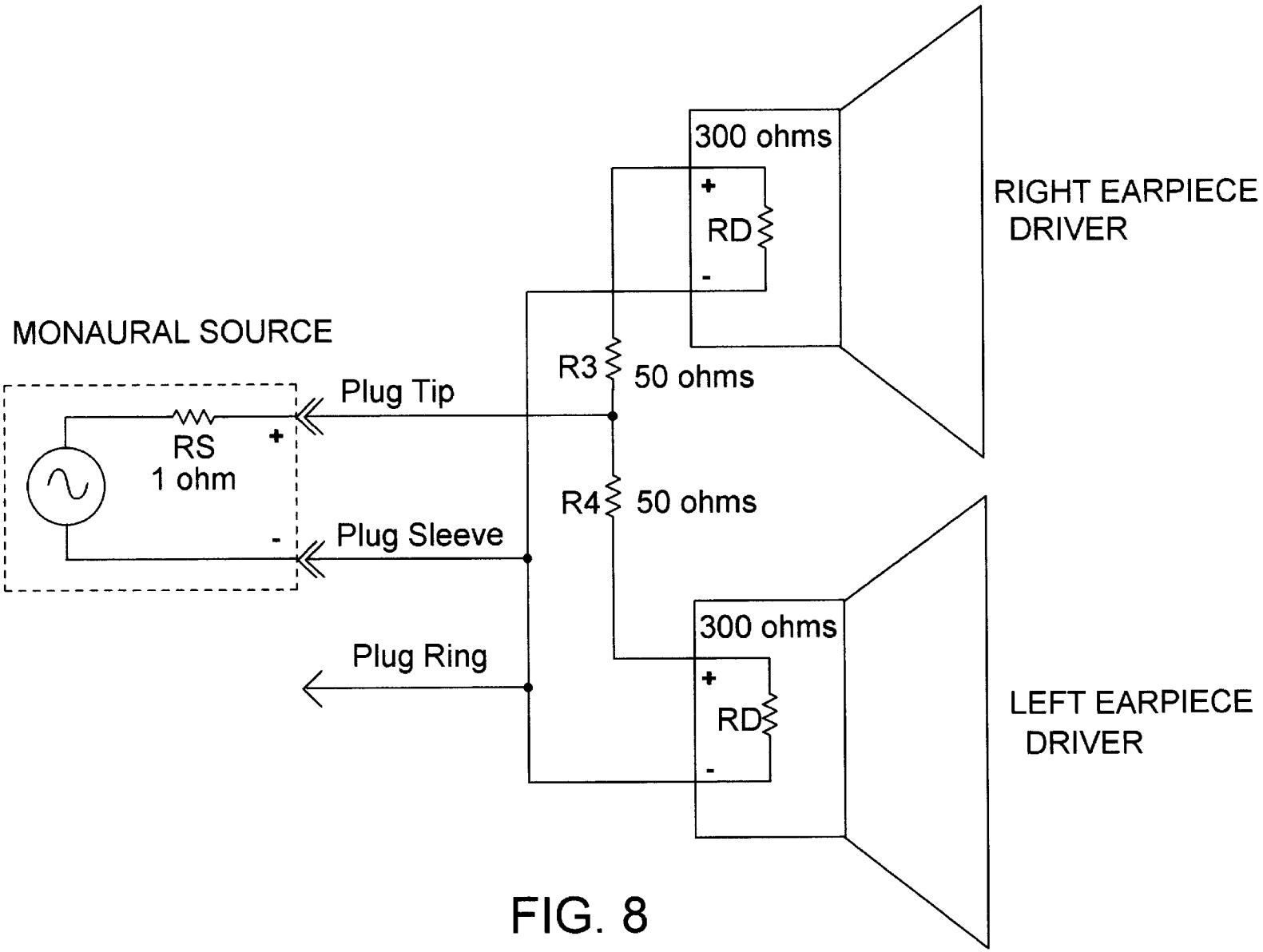
FIG. 8 is a schematic drawing of a second embodiment the present invention showing its connection to a monaural audio source.

FIG. 8 is a schematic diagram of the second embodiment when accessing a monaural source. If the resistors $R_3$ and $R_4$ are each given ½ the value (50 ohms) of the resistor $R_1$ (100 ohms) used in the first embodiment of the invention, the reduction in loudness at each earpiece is only 1.3 decibels, and the monaural signal is received with equal loudness at both earpieces.

Figure 9:
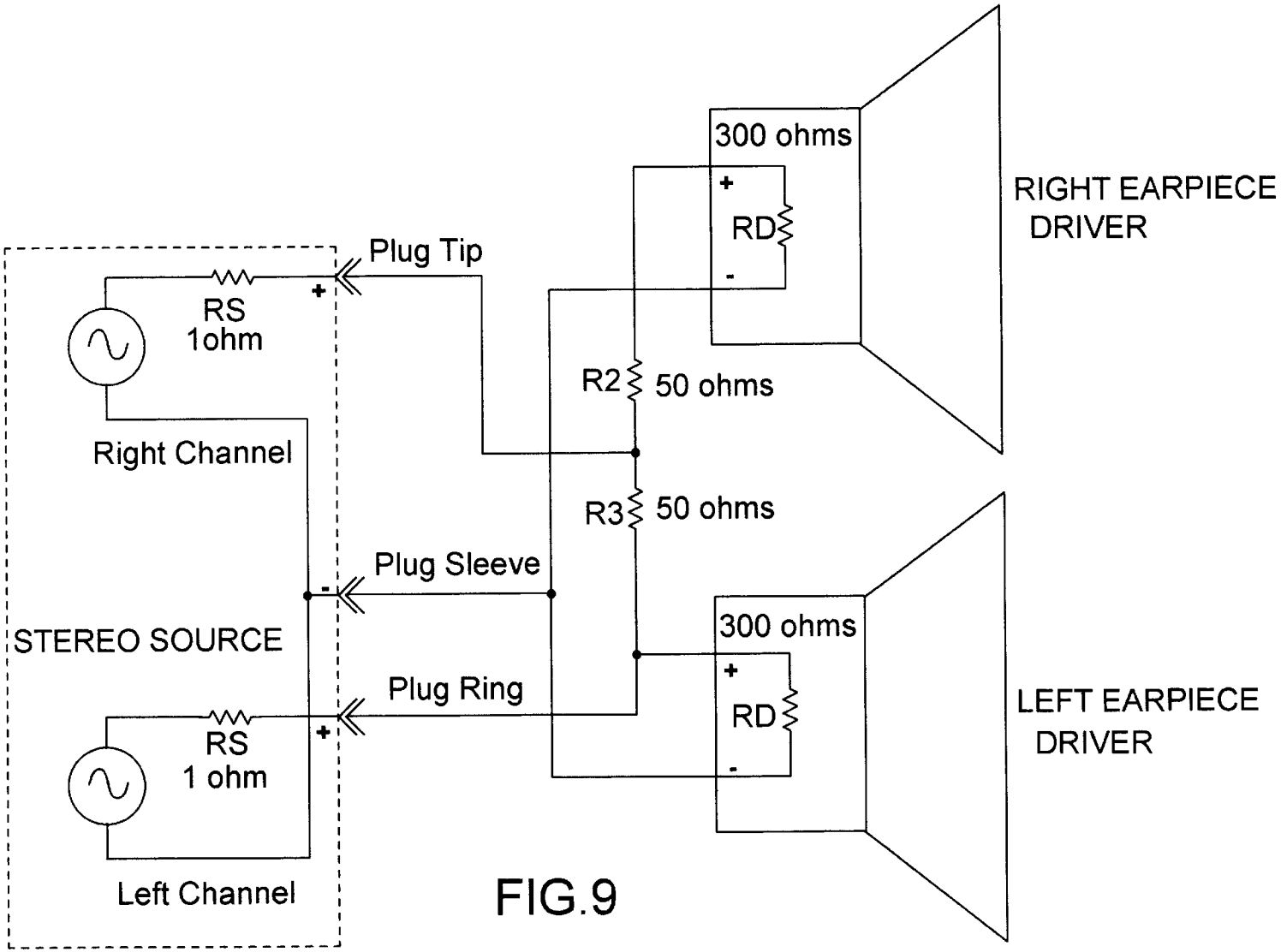
FIG. 9 is a schematic drawing of a second embodiment the present invention showing its connection to a stereo audio source.

FIG. 9 is a schematic diagram of the second embodiment of the invention when accessing a stereo audio source. Since the left channel receives the signal directly from the plug ring and the right channel receives the signal from the plug tip through the 50 ohm resistor $R_2$ the right channel loudness is 1.3 decibels lower than the left channel. Again, this slight difference in loudness is not perceptible. Many stereo sources have a balance control that can adjust this small difference if it further contributes to a perceptible difference in channel balance. Crosstalk between channels is increased from −40 decibels of the first embodiment to −34 decibels, which still results in an imperceptible difference in stereo imaging.

Both embodiments of this invention described above exhibit excellent efficacy in providing a headset with automatic monaural/stereo listening that virtually equals the performance of an individual monaural or stereo headset or a single headset that can be configured by a switch or plug adapters to duplicate the performance of an individual monaural or stereo headset. The table below shows the differences in the performance between the two embodiments and individual headsets.

| AUDIO | RIGHT EARPIECE LOUDNESS EMBODIMENT | | LEFT EARPIECE LOUDNESS EMBODIMENT | | STEREO CROSSTALK EMBODIMENT | |
|---|---|---|---|---|---|---|
| SOURCE | 1 | 2 | 1 | 2 | 1 | 2 |
| Monaural | 0 dB | −1.3 dB | −2.5 dB | −1.3 dB | NA | NA |
| Stereo | 0 dB | −1.3 dB | 0 dB | 0 dB | −40 dB | −34 dB |

From a theoretical viewpoint embodiment 1 may be preferred by those whose main interest is to maximize stereo performance, whereas others whose primary use involves monaural sources might prefer the slightly better loudness balance of embodiment 2. In either case, the choice would be very difficult to make based upon comparative listening tests.

While the invention has been described with reference to a preferred embodiment, it will be understood by those skilled in the art that other embodiments are possible. It should be recognized that some variation could be made in the resistor values shown in the above illustrations without materially reducing the efficacy of this invention. Earpiece drivers that vary significantly from the examples shown above will require different impedance element values to preserve substantially the same ratios to the driver impedance as is shown in the illustrations of this disclosure. Depending upon the characteristics of the earpiece drivers it might be desirable to design the impedance element(s) 100, 102, and 103 shown in FIGS. 4 and 7 as complex impedances rather than pure resistors by including inductive or capacitive components in them. Furthermore, while generally specific claimed details of the invention constitute important specific aspects of the automatic monaural/stereo headphone, in appropriate instances even the specific claims should be considered in light of the doctrine of equivalents.

What is claimed is:

1. In a automatic monaural/stereo headphone having two earpieces in which each earpiece includes an acoustical driver, a connection cord connected to each acoustical driver that is terminated in a stereo headphone plug for accessing a conventional two channel stereo audio source, said headphone being adapted for automatically accessing a typical single channel monaural signal source when plugged into a monaural source output jack, and for automatically accessing a typical stereo source when plugged into said stereo source output jack, said adaptation comprising:

a coupling impedance connected from one terminal of one of said acoustical drivers to one terminal of said other acoustical driver, said impedance being of such magnitude with respect to the impedance of said acoustical drivers that a monaural signal appearing at said terminal of only one acoustical driver will be coupled to said terminal of said other acoustical driver with little reduction in the magnitude of said signal that the listener will perceive the monaural signal as being heard with substantially equal loudness at each earpiece; and furthermore, that the ratio of said coupling impedance to said output impedance of said typical stereo audio source is so low that when accessing said typical stereo audio source, the stereo source separate first and second channel signals appearing at their respective earpieces are heard with substantially no reduction in loudness, and the crosstalk between channels resulting from said coupling impedance will not substantially change the channel separation or stereo imaging as afforded by the two channel stereo source, whereby, the user of said headphone can access either a typical monaural or typical stereo audio source without having in advance to determine the nature of the source and can automatically hear either source substantially as it would be heard using separate dedicated headphones wherein one headphone is configured and selected especially for a monaural source and the other headphone is configured and selected especially for a stereo source.

2. The automatic monaural/stereo headphone defined in claim 1 wherein the connection plug is a one-eighth inch stereo plug and there is included with the headphone a one-eighth-to-one-quarter inch stereo plug adapter.

3. The automatic monaural/stereo headphone defined in claim 2 wherein said plug adapter is provided with attachment means to the headphone that keeps said plug adapter with the headphone when it is not in use thereby avoiding its misplacement and potential loss.

4. In an automatic monaural/stereo headphone comprising first and second earpieces in which each earpiece includes an acoustical driver having first and second differently identified connection terminals, a connection cord connected to each acoustical driver that is terminated in a conventional stereo phone plug, said headphone being adapted for automatically accessing a single channel monaural audio source having first and second identified connection terminals and for accessing a typical stereo audio source having separate first and second audio channels, each of said channels having first and second identified connection terminals, said phone plug having a sleeve contact for connecting said first identified terminal of each acoustical driver to said first identified terminal of said monaural audio source and to said first identified terminals of each said first and second channel outputs of said stereo audio source, and a tip contact for connecting said second identified terminal of said first acoustical driver to said second identified terminal of said monaural audio source and to said second identified terminal of said first channel output of said stereo source, and a ring contact for connecting said second identified terminal of said second acoustical driver to said second identified terminal of said second channel output of said stereo source, said adaptation comprising:

a coupling impedance connected between said second identified terminal of said first acoustical driver and said second identified terminal of said second acoustical driver, said impedance being of such magnitude with respect to the impedance of said acoustical drivers that said monaural audio signal appearing at the second identified terminal of said first acoustical driver will be coupled to said second identified terminal of said second acoustical driver with little reduction in the magnitude of said signal that the listener will perceive that the monaural signal is being heard with substantially equal loudness at each earpiece; and furthermore, that the ratio of said coupling impedance to said output impedance of said typical stereo audio source is so low that when accessing said typical stereo audio source, said separate stereo first and second channel signals appearing at their respective earpieces are heard with substantially no reduction in loudness, and the crosstalk between channels resulting from said coupling impedance will not substantially change the channel separation or stereo imaging as afforded by the two channel stereo source, whereby, the user of said headphone can access either a monaural or typical stereo audio source without having in advance to determine the nature of the source and can automatically hear either source substantially as it would be heard using separate dedicated headphones wherein one headphone is configured and selected especially for a monaural source and the other headphone is configured and selected especially for a stereo source.

5. The automatic monaural/stereo headphone defined in claim 4 wherein the connection plug is a one-eighth inch stereo plug and there is included with the headphone a one-eighth-to-one-quarter inch stereo plug adapter.

6. The automatic monaural/stereo headphone defined in claim 5 wherein said plug adapter is provided with attachment means to the headphone that keeps said plug adapter with the headphone when it is not in use thereby avoiding its misplacement and potential loss.

7. In an automatic monaural/stereo headphone comprising first and second earpieces in which each earpiece includes an acoustical driver having first and second differently identified connection terminals, a connection cord connected to each acoustical driver that is terminated in a conventional stereo phone plug, said headphone being adapted for automatically accessing a single channel monaural audio source having first and second identified connection terminals and for accessing a typical stereo audio source having separate first and second audio channels, each of said channels having first and second identified connection terminals, said phone plug having a sleeve contact for connecting said first identified terminal of each acoustical driver to said first identified terminal of said monaural audio source and to said first identified terminals of each said first and second channel outputs of said stereo audio source, and a tip contact for connecting said second identified terminal of said first acoustical driver to said second identified terminal of said monaural audio source and to said second identified terminal of said first channel output of said stereo source, and a ring contact for connecting said second identified terminal of said second acoustical driver to said second identified terminal of said second channel output of said stereo source, said adaptation comprising:

a first coupling impedance connected between said second identified terminal of said first acoustical driver and said plug tip contact, and a second coupling impedance connected between said second identified terminal of said second acoustical driver and said plug tip contact, said first and second impedance being of such magnitude with respect to the impedance of said acoustical drivers that a monaural signal applied to said plug tip contact is coupled to first and second acoustical driver with insignificant reduction in the magnitude of said signal and the monaural signal is heard with equal loudness at each earpiece; and furthermore, that the ratio of said coupling impedance to said output impedance of each channel of said typical stereo audio source is so low that when accessing said typical stereo audio source, said separate stereo channel signals of equal magnitude appearing at their respective earpiece drivers are heard with little difference in loudness that a listener will perceive them to be of equal loudness, and the crosstalk between channels resulting from said first and second coupling impedance will not substantially change the channel separation or stereo imaging, as afforded by the two channel stereo source, whereby, the user of said headphone can access either a monaural or stereo audio source without having in advance to determine the nature of the source and can automatically hear either source substantially as it would be heard using separate dedicated headphones wherein one headphone is configured and selected especially for a monaural source and the other headphone is configured and selected especially for a stereo source.

8. The automatic monaural/stereo headphone defined in claim 7 wherein the connection plug is a one-eighth inch stereo plug and there is included with the headphone a one-eighth-to-one-quarter inch stereo plug adapter.

9. The automatic monaural/stereo headphone defined in claim 8 wherein said plug adapter is provided with attachment means to the headphone that keeps said plug adapter with the headphone when it is not in use thereby avoiding its misplacement and potential loss.

10. The automatic monaural/stereo headphone defined in claim 7 wherein said first and second coupling impedances are of equal value.

* * * * *